US012544646B2

(12) United States Patent
Pechtold

(10) Patent No.: US 12,544,646 B2
(45) Date of Patent: Feb. 10, 2026

(54) GLOVE, IN PARTICULAR GOALKEEPER GLOVE

(71) Applicant: adidas AG, Herzogenaurach (DE)

(72) Inventor: Andre Pechtold, Neustadt an der Aisch (DE)

(73) Assignee: adidas AG, Herzogenaurach (DE)

( * ) Notice: Subject to any disclaimer, the term of this patent is extended or adjusted under 35 U.S.C. 154(b) by 0 days.

(21) Appl. No.: 17/022,447

(22) Filed: Sep. 16, 2020

(65) Prior Publication Data

US 2021/0077891 A1 Mar. 18, 2021

(30) Foreign Application Priority Data

Sep. 17, 2019 (DE) ..... 10 2019 214 140.4

(51) Int. Cl.
*A41D 19/00* (2006.01)
*A41D 19/015* (2006.01)
*A63B 71/14* (2006.01)

(52) U.S. Cl.
CPC ..... *A63B 71/148* (2013.01); *A41D 19/00* (2013.01); *A41D 19/0058* (2013.01); *A41D 19/015* (2013.01); *A41D 19/01517* (2013.01); *A41D 19/01523* (2013.01); *A63B 2243/0025* (2013.01)

(58) Field of Classification Search
CPC ..... A63B 71/14; A63B 71/143; A41D 19/01529; A41D 19/01547; A41D 19/01552; A41D 19/01558; A41D 19/01564; A41D 2400/80; A43B 5/025
USPC ..... 2/159
See application file for complete search history.

(56) References Cited

U.S. PATENT DOCUMENTS 1,513,237 A * 10/1924 Green ..... A41D 19/0157 63/26
1,559,114 A * 10/1925 Maranville ..... D06F 1/00 2/168
6,081,928 A * 7/2000 Bourne ..... A41D 19/0055 2/163
6,523,282 B1 * 2/2003 Johnston ..... A43B 5/02 36/133
7,487,605 B2 * 2/2009 Hatzilias ..... A43B 5/02 36/133

(Continued)

FOREIGN PATENT DOCUMENTS

CN 102137599 A 7/2011
CN 202876301 U 4/2013

(Continued)

OTHER PUBLICATIONS

Chinese Office Action issued in Chinese Application No. 202010978782.1, mailed Jan. 28, 2022, 12 pages.

(Continued)

*Primary Examiner* — Alissa L Hoey
*Assistant Examiner* — Akwokwo Olabisi Redhead
(74) *Attorney, Agent, or Firm* — Sterne, Kessler, Goldstein & Fox P.L.L.C.

(57) ABSTRACT

A glove, in particular a goalkeeper glove. The glove includes a plurality of protrusions that protrude from a backside of the glove and extend in a first direction away from the backside. The protrusions are adapted to deform in a second direction that includes a component perpendicular to the first direction.

20 Claims, 11 Drawing Sheets

(56) References Cited

U.S. PATENT DOCUMENTS

| | | | | |
|---|---|---|---|---|
| 8,100,089 | B1 * | 1/2012 | Francoeur | A01K 13/002 119/625 |
| 8,215,959 | B2 * | 7/2012 | Elseri | A46B 1/00 15/104.93 |
| 9,375,051 | B2 * | 6/2016 | Doremus | B41J 3/4073 |
| 9,781,960 | B2 | 10/2017 | Tuma | |
| 2004/0025226 | A1 | 2/2004 | Jaeger | |
| 2006/0168706 | A1 | 8/2006 | Auger et al. | |
| 2006/0218821 | A1 * | 10/2006 | Hatzilias | A43B 5/025 36/133 |
| 2006/0272116 | A1 * | 12/2006 | Thompson | A47L 13/18 15/227 |
| 2007/0209097 | A1 | 9/2007 | Iacullo | |
| 2007/0226874 | A1 * | 10/2007 | Cain | A01K 13/002 2/159 |
| 2008/0201823 | A1 | 8/2008 | Jaeger | |
| 2009/0307820 | A1 | 12/2009 | Yang | |
| 2010/0183814 | A1 * | 7/2010 | Rios | A63B 60/00 427/387 |
| 2011/0177874 | A1 | 7/2011 | Edwards | |
| 2012/0005805 | A1 | 1/2012 | Bevier et al. | |
| 2012/0167274 | A1 | 7/2012 | Tuma | |
| 2013/0055963 | A1 * | 3/2013 | Salter | A01K 13/002 119/600 |
| 2013/0281234 | A1 | 10/2013 | Ramirez | |
| 2015/0128324 | A1 * | 5/2015 | Baker | A41D 19/01523 2/169 |
| 2015/0181955 | A1 * | 7/2015 | Hughes | A41D 19/01523 66/174 |
| 2017/0142931 | A1 * | 5/2017 | Michaelson | A01K 13/002 |
| 2017/0290291 | A1 * | 10/2017 | Moeller | A46D 1/0253 |
| 2019/0315083 | A1 * | 10/2019 | Hartmann | A41D 19/01523 |
| 2019/0387818 | A1 | 12/2019 | Kishihara | |
| 2021/0127635 | A1 * | 5/2021 | Michaelson | B29C 45/16 |
| 2023/0346054 | A1 * | 11/2023 | Geva | A63B 71/141 |

FOREIGN PATENT DOCUMENTS

| | | | | |
|---|---|---|---|---|
| CN | 206934690 | U | 1/2018 | |
| DE | 29905619 | U1 | 7/1999 | |
| DE | 102009050586 | A1 | 5/2011 | |
| JP | 599019 | U | 1/1984 | |
| JP | 2018127726 | A | 8/2018 | |
| JP | 2018525537 | A | 9/2018 | |
| KR | 101345655 | B1 | 12/2013 | |
| WO | WO-2005025304 | A1 * | 3/2005 | A01K 13/001 |
| WO | 2012068418 | A1 | 5/2012 | |
| WO | 2017025110 | A1 | 2/2017 | |
| WO | WO-2017124134 | A1 * | 7/2017 | A41D 19/0062 |

OTHER PUBLICATIONS

Extended European Search Report issued in European Application No. 20195895.6, mailed Feb. 4, 2021, 7 pages.

Chinese Notification of the First Office Action issued in Chinese Application No. 202010978782.1, mailed Jul. 1, 2021, 16 pages.

Notice of Reasons for Refusal issued in Japanese Application No. 2020-153408 mailed Aug. 31, 2021, 11 pages.

* cited by examiner

FIG 10C State of the Art
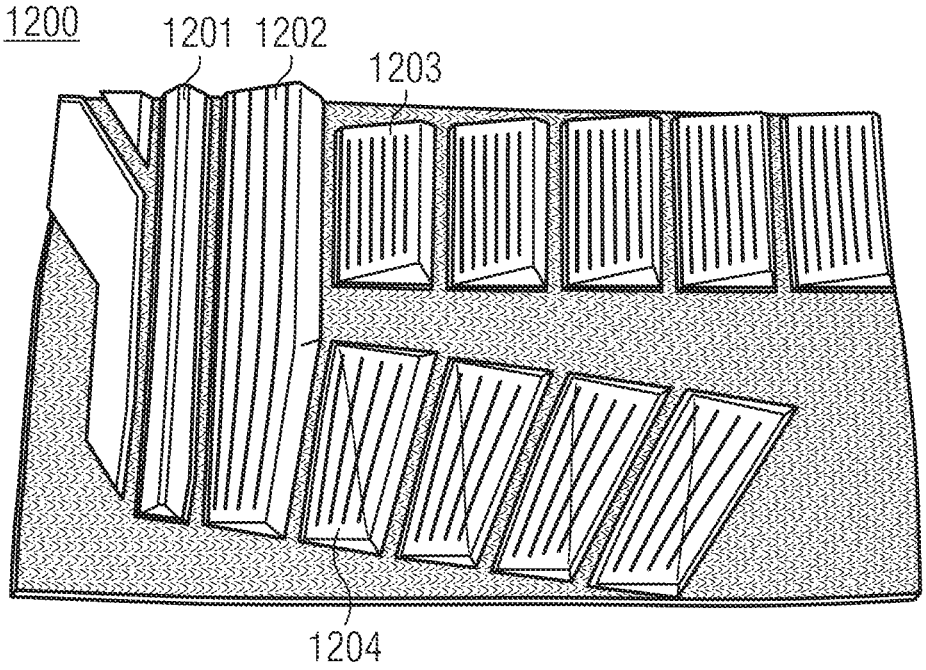
FIG 10D State of the Art
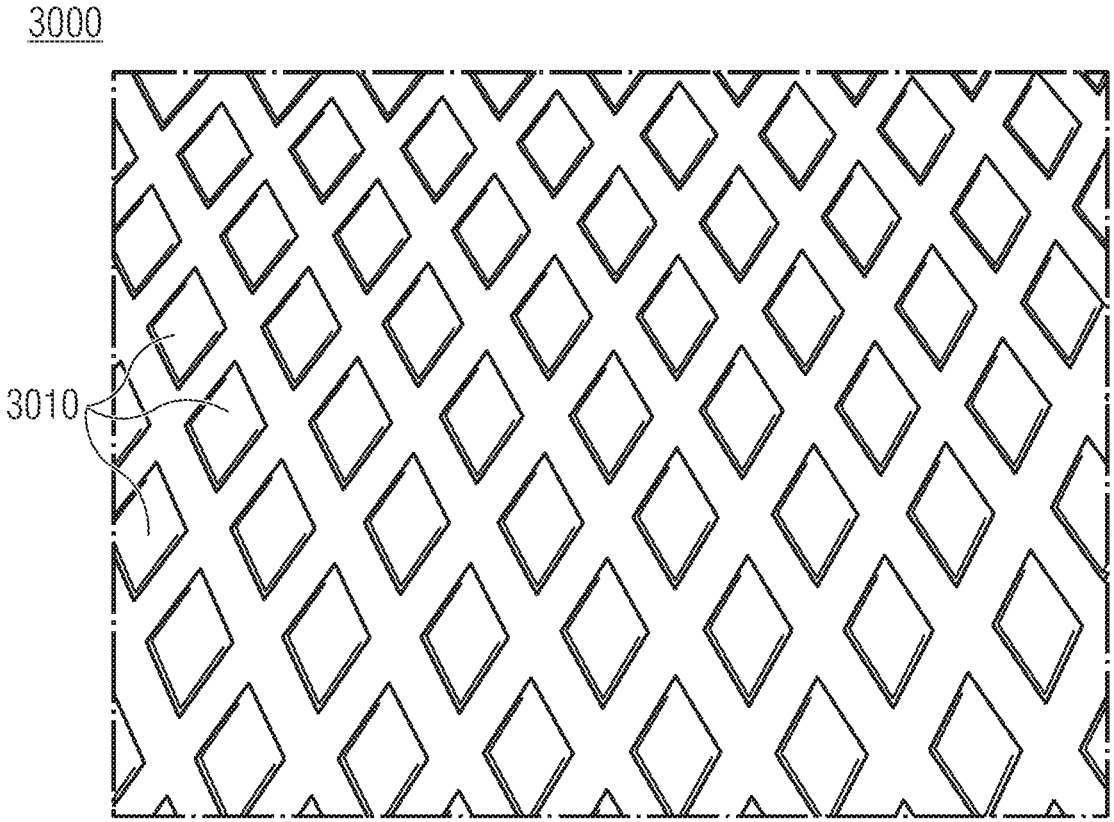

GLOVE, IN PARTICULAR GOALKEEPER GLOVE

TECHNICAL FIELD

The present invention relates to a glove, in particular a goalkeeper glove.

STATE OF THE ART

Gloves have been known for a long time in many different forms. On the one hand, gloves may serve to protect the hands from a number of environmental influences such as cold, heat or friction. In particular, gloves may protect the hands from injuries caused by chemical or physical impacts, such as blows or cuts. For example, flexible elements are known from EP 2 901 875 B1, which may be applied to gloves to protect the hand from the effects of pressure. Preferably, the elements are each designed in the shape of a pyramid comprising a recess at the top such that the lateral surfaces of the pyramid-shaped element may fold inwards when the elements are subjected to pressure acting vertically on them. From U.S. Pat. No. 10,342,274 B2, another type of protective element is known, which may be applied in the area of the backsides of the fingers in particular. On the other hand, gloves may also support the hands in their functionality. For example, there is a large number of gloves in which the palm area in particular is adapted to improve the grip of the hand. The wearer of the glove may thus grip a wide variety of objects more securely and, under certain circumstances, more firmly.

All these aspects play an important role especially also in the field of sports. Gloves are used in numerous sports, both to protect the hands, such as in ice hockey, and to support and improve the hands in their functionality, such as in golf. For example, KR 101345655 B1 discloses a golf glove with a number of holes which may improve the grip, but also the ventilation of the hand. U.S. Pat. No. 8,082,601 B2 discloses a number of air-filled elements in the palm area of a glove, which may be of advantage when operating a club.

Last but not least, gloves have also been used in soccer and handball for decades. Goalkeeper gloves, especially in the area of the palms and the insides of the fingers, are usually designed in such a way that they enable the ball to be caught particularly securely. In addition, some elements are sometimes provided in or on the glove which may work together to prevent an overstretching of the fingers if they come into unfavorable contact with the ball, as is known, for example, from EP 1 378 273 B1. A similar concept, although not explicitly related to soccer or handball, is also disclosed by JP 6321276 B1. From CN 206777805U, inserts for a goalkeeper glove are known, which may be placed over the finger bones near the palm.

However, in some game situations it may be hardly possible for the goalkeeper to catch the ball securely, for example when the ball is flying at some height or the goalkeeper is too far away from the ball to reach it with both hands. Instead, he must try to deflect the ball in some other way. In such cases, a goalkeeper often uses his clenched and extended fist. In traditional jargon, this is called "fisting away."

However, such a fisting away offers considerably less control than a catching. Not only is the ball usually not with the goalkeeper after fisting away—unlike as with a successful catching. Also, the direction in which the ball is deflected by the fisting away may hardly be controlled sufficiently exactly. The goalkeeper risks with a fisting-away and the resulting lack of ball control that the ball jumps directly in front of the opponent's feet or is not deflected at all.

The present invention is therefore based on the problem of providing a glove that increases the control of an object, in particular a ball, hitting the backside of the glove.

SUMMARY OF THE INVENTION

This problem is at least partially solved by a glove according to independent claim 1.

In an embodiment of the invention, a glove, in particular a goalkeeper glove, includes a plurality of protrusions, wherein the protrusions protrude from a backside of the glove and extend in a first direction away from the backside, and wherein the protrusions are adapted to deform in a second direction that includes a component perpendicular to the first direction.

This provides a glove that offers a significantly increased level of control when fisting away a ball. By having a plurality of protrusions protrude from the backside of the glove and extending in a first direction away from the backside, the ball may interact with this plurality of protrusions instead of with an often largely smooth surface, thereby increasing friction between the glove and the ball and consequently ball control.

The fact that the protrusions are adapted to deform in a second direction that includes a component perpendicular to the first direction may further enhance this effect. Insofar as a deformability of the protrusions is referenced in the following, this refers to deformability under forces such as those which usually occur in ball sports such as handball and/or soccer, in particular upon contact between a goalkeeper glove and a ball. Moreover, protrusions are preferably elastically or reversibly deformable, i.e., they resume their original shape as soon as no more force is applied to them. Furthermore, a deformation in the second direction thus refers to a deformation that acts at least partially perpendicular to the first direction in which the protrusions extend. Expressly not meant is a deformation, which acts exclusively perpendicular to the first direction. In particular, the plurality of protrusions may be adapted to deform in the second direction upon contact of the backside of the glove with a ball such that a contact area of the glove with the ball is greater than without deformation of the plurality of protrusions. For example, the protrusions may be deformed by the ball contact in such a way that they follow the sphericity of the ball, both as a whole and individually.

In particular, the contact area may also be increased by multiple of the plurality of protrusions being tilted and/or sheared in the second direction. In this case, the ball does not only come into contact with end portions and/or upper parts of the protrusions. Rather, the lateral surfaces of the respective protrusions then also abut at least partially against the ball. Especially in situations where the ball moves at least partially parallel to the glove surface, especially in the second direction, the protrusions may thus virtually "hook" into the ball.

In some embodiments, at least one protrusion includes a notch facilitating deformation. This may further enhance the described desirable effects caused by the general deformability of the protrusions. It may also allow varying of the stiffness and/or firmness of the respective protrusion in different directions. This may lead to the ball being deflected preferably in a certain direction.

It may also serve better control when fisting away, if at least one protrusion is arranged in an orientation tilted towards the backside of the glove before a deformation.

Where a tilted orientation (or, in short, a tilt) is referenced in the following, a tilted orientation before a deformation is always meant. Due to a tilted orientation, protrusions may take stiffer and/or firmer effect in selected directions than in others and thus help to deflect the ball preferably in a certain direction. In particular, this may also be used to cause at least one protrusion to be deformed against its tilted orientation upon contact of the backside of the glove with a ball. This results in a particularly high restoring force in the respective protrusion, which may lead to even greater friction between the glove and the ball and thus further improve ball control.

In some embodiments, a tilted orientation may be oriented towards the fingertips of the glove. A protrusion is oriented towards the fingertips of the glove even if it is only partially oriented towards the fingertips. In other words, it is sufficient if a vector describing the orientation of the protrusion includes a non-zero component for the direction pointing along the extension direction of the fingers. Then, as described above, a particularly high friction between the ball and the glove develops when the ball hits the glove along a direction essentially determined by the extension direction of the fingers. It is precisely such constellations that very often occur in the game since the goalkeeper usually moves his hand towards the ball with his fingers (possibly clenched in a first) in front by extending the corresponding arm. In other words, an orientation of the tilted orientation in the direction of the fingertips may favor the invention to develop its beneficial effects to a particularly high degree as often as possible during the game.

At least one protrusion may include a kite, rhomb or linear base. As a result, the respective protrusion may take stiffer and/or firmer effect in some directions and thus develop a greater restoring force than in others. This may also help the ball being deflected preferably in a certain direction upon contact with the backside of the glove, thereby increasing ball control. Yet, in some embodiments, at least one protrusion includes a round base in order to take equally stiff and/or firm effect in all directions.

In some embodiments, a diameter of at least one protrusion may vary along the first direction. The diameter of a protrusion is the maximum possible distance between two points lying on a lateral surface of the protrusion and in a plane perpendicular to the first direction. For example, the at least one protrusion may taper towards an end portion opposite a base. This means that an upper part of a protrusion may be more easily deformed than a lower part, so that although the contact surface between the ball and the glove may increase as described above, the protrusions may still develop the necessary restoring force to ultimately hold (back) and deflect the ball. Conversely, the at least one protrusion may also taper towards the base, so that although it is easily deformed, it also allows for a particularly large contact area between the ball and the glove. In other embodiments, at least one protrusion may include a shape in which a diameter alternately increases and decreases. This may allow a particularly precise adjustment of the deformability of the corresponding protrusion and its contact area with a ball.

In some embodiments, an end portion—which by definition always faces a base of a protrusion in the first direction—of at least one protrusion may include a spherical, ellipsoidal or funnel shape. In this way, injuries to third parties by the protrusions may be avoided and/or the possible contact area of the at least one protrusion with a ball may be further adjusted, for example enlarged.

At least one protrusion may be adapted to abut against an adjacent protrusion when it is deformed in the second direction. This may be achieved, for example, by having end portions of protrusions include a larger diameter than a respective base, such as when the end portions include a spherical shape, an ellipsoidal shape or a funnel shape as just described. When adjacent protrusions abut against each other, they may support each other and thus develop a greater restoring force, which in turn may lead to increased friction with the ball and thus to improved ball control.

Also, protrusions—both for this purpose and in general—may differ in size, in particular height, shape and/or orientation. The height of a protrusion denotes its extension in the first direction. The orientation of a protrusion is the direction of its tilted orientation. The number of protrusions per unit area, i.e., the (distribution-)density of the protrusions, may also be varied across the backside of the glove. This allows a high degree of flexibility in the design of a, so that it may be adapted to the respective purposes and needs. For example, the size, shape, orientation and/or (distribution-) density of the protrusions may be varied at will—if necessary even individually for a particular wearer—in order to take greater advantage of the above-described beneficial effects of the deformable, tilted protrusions in certain areas of the glove and/or in certain directions than in others.

It may be particularly advantageous to provide the protrusions in the area of the knuckles, as this is the area that typically comes into contact with the ball when fisting away. But also in the area of the backside of the hand and/or in the area of the thumb, in particular in the area of the base joint of the thumb, the deformable, tilted protrusions may be advantageous, because the wearer of the glove cannot always hit the ball with the knuckles in front. In some situations, the ball will hit the backside of the hand or even the outside of the thumb. It may be important that a glove also allows a high degree of ball control in such cases, which may be ensured by protrusions in these areas.

Additionally or alternatively, at least one protrusion may also be curved. This may also favor that the respective protrusion may be more easily deformed by the ball, for example tilted, sheared or bent, and still build up sufficient restoring force.

Also, each protrusion may be individually attached to the backside of the glove, so protrusions do not protrude from a common base element. Not only may the above-mentioned freedom of design be further increased. It also makes it easier to repair or replace individual protrusions, which may have a positive effect on the durability and environmental friendliness of the gloves. In particular, it may also be avoided that a flat base element (from which the plurality of protrusions would then protrude) has to be attached to the glove, which could restrict the freedom of movement of the hand. If each protrusion is individually attached to the backside of the glove, the wearing comfort of the glove may be increased without the protrusions losing any functionality.

In some embodiments, at least one protrusion includes silicone. It has been found that silicone is particularly suitable for the protrusions. Therefore, in some embodiments, several, if not all, protrusions are made of silicone.

The protrusions may include a hardness in the range of 10-50 Shore A, preferably in the range of 15-35 Shore A, especially preferably in the range of 20-30 Shore A, in particular a hardness of 26 Shore A. It has been found that the purpose of the invention may be achieved particularly well with these hardness values, as the protrusions are sufficiently soft to be easily deformed, for example tilted, sheared or bent, but still stiff or firm enough to develop the necessary tension and thus restoring force to effectively hold (back) and deflect the ball.

As mentioned, the protrusions are preferably elastically or reversibly deformable, i.e., they resume their original shape as soon as no more force is applied to them.

BRIEF DESCRIPTION OF THE FIGURES

Possible embodiments of the present invention are described in more detail in the following detailed description with reference to the following Figures:

FIG. 5 shows an exemplary torque measurement for a sole element with and without a composite element.

FIG. 10C shows a test specimen with a plurality of protrusions known from the state of the art.

FIG. 10D shows a friction surface known from the state of the art for use in determining a coefficient of static friction.

DETAILED DESCRIPTION OF POSSIBLE EMBODIMENTS

For the sake of brevity, only a few embodiments will be described below. The person skilled in the art will recognize that the features described with reference to these specific embodiments may be modified and combined in different ways and that individual features may also be omitted. The general explanations in the sections above also apply to the more detailed explanations below.

Figure 1:
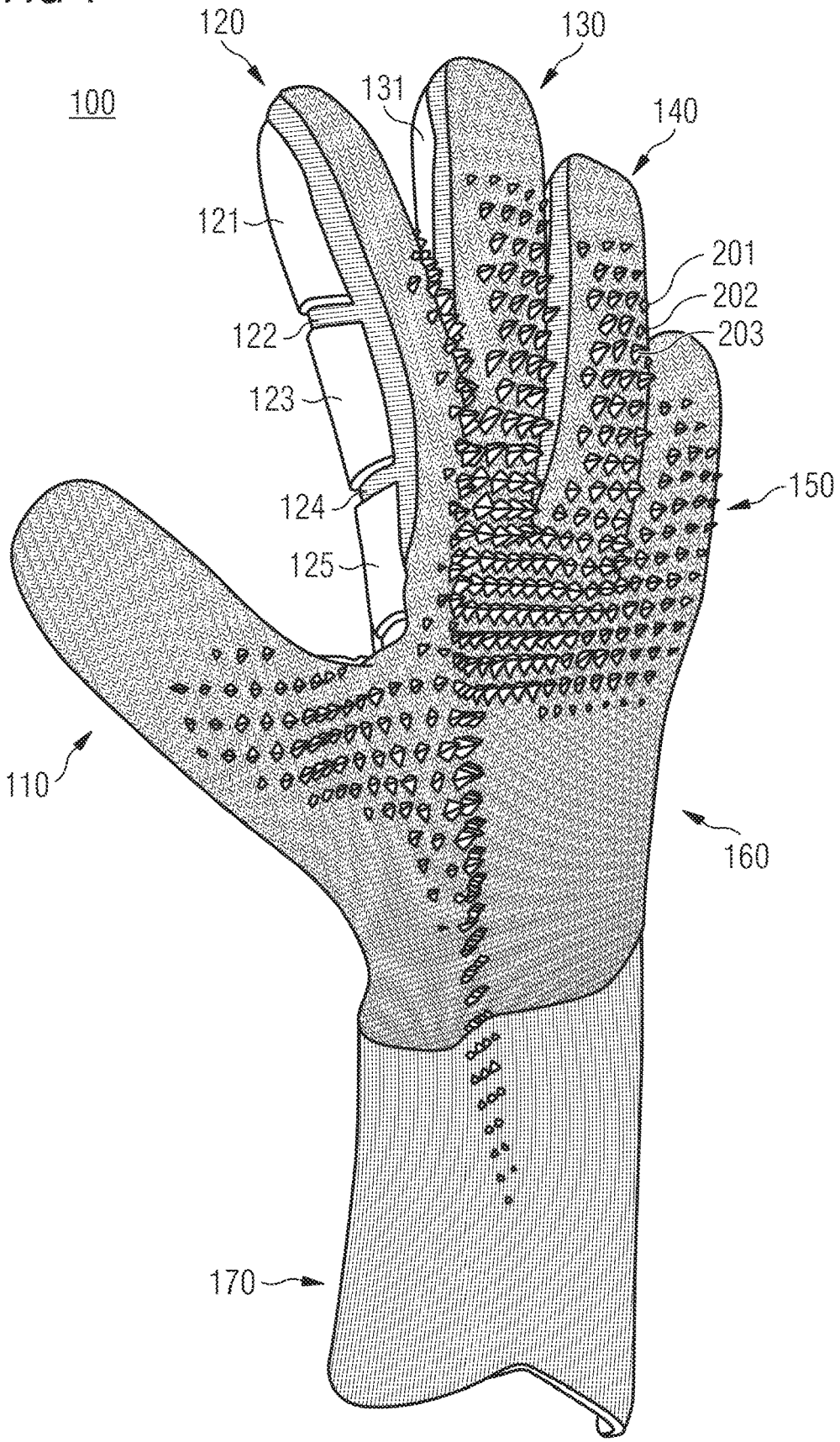
FIG. 1 shows an exemplary embodiment of a goalkeeper glove with a plurality of protrusions, wherein the protrusions protrude from a backside of the glove and extend in a first direction away from the backside, and wherein the protrusions are adapted to deform in a second direction that includes a component perpendicular to the first direction.

FIG. 1 shows an embodiment of a goalkeeper glove 100. The glove 100 includes a thumb 110, an index finger 120, a middle finger 130, a ring finger 140 and a pinkie 150, the backsides of which are visible in FIG. 1. The backside of a finger or of a glove as a whole denotes the side facing away from the palm of the wearer's hand when the glove is worn. In particular, such a backside is therefore also turned away from the palm of the wearer's hand when he is wearing the glove. The glove 100 further includes a backside of the hand area 160 and a wrist area 170.

The glove 100 includes one or more gripping elements in the area of a frontside. The frontside of a glove—as opposed to a backside—denotes the side which is in contact with the inside of the wearer's hand when he is wearing the glove. In particular, the area of the glove that rests on the palm of the wearer's hand when wearing the glove belongs to the frontside of a glove. In the embodiment of FIG. 1, for example, at least gripping elements 121, 123, 125 are arranged on the frontside of the index finger 120, which may, for example, include special materials to increase the grip of the glove. There is also at least one gripping element 131 arranged on the frontside of the middle finger 130. Strips 122, 124 are arranged between the gripping elements 121, 123, 125. The strips 122, 124 may be arranged and adapted to facilitate a bending of the index finger 120. For example, the strips 122, 124 may be arranged so that they are located above the joints of the wearer's index finger when wearing the glove 100. Alternatively or additionally, strips 122, 124 may include one or more particularly flexible materials.

The glove 100 does not include a fastening mechanism. However, fastening mechanisms may be provided in other embodiments, in particular for example in the wrist area 170. Possible fastening mechanisms may include, but are not limited to, a hook-and-loop fastener.

In some embodiments, a glove such as the glove 100 may be obtained by applying various elements such as the gripping elements 121, 123, 125, 131 to a surface of an otherwise elastic preform of the glove, for example by gluing, sewing or ironing them on. In some embodiments, different elements such as the gripping elements 121, 123, 125, 131 may also be fused to the preform for attachment. The preform may already be shaped so that it encloses the wearer's entire hand. In other embodiments, the preform may be shaped in such a way that it does not enclose the entire hand of the wearer, but rather includes gaps, holes and/or recesses in which the other elements such as the gripping elements 121, 123, 125, 131 may be placed and fixed.

In some embodiments, a glove such as the glove 100 includes a flexible material, in particular a textile material or a polymeric material. Such material may be woven or knitted, in particular flat knitted. In an embodiment, at least part of a glove such as the glove 100 may be flat-knitted from a material consisting of 91% polyester, 8% elastane and 1% polyamide and thus comprising a mass per unit area of 860 g/m$^2$. However, a glove such as the glove 100 may also include a non-woven fabric, in particular one obtained by means of a so-called melt-blown or a so-called spun-bond process. In other embodiments, also a multilayer material may be used for a glove such as the glove 100, as will be further described in connection with FIG. 11.

Glove 100 includes a plurality of protrusions 201, 202, 203 (not all provided with reference signs) on its backside. The protrusions 201, 202, 203 protrude from the backside, i.e., they are for example attached to the backside. They extend in a first direction away from the back. In the embodiment of FIG. 1, the protrusions 201, 202, 203 are arranged in particular in the area of the knuckles, in the area of the thumb 110, in particular in the area of the base joint of the thumb, and in the area of the fingers 120, 130, 140, 150, but not in the area of the fingertips. In addition, the protrusions 201, 202, 203 are arranged in an area that extends from an area between the thumb 110 and the index finger 120 to the wrist area 170. In other embodiments, protrusions such as protrusions 201, 202, 203 are arranged additionally or alternatively in other areas of the backside. Also, protrusions like the protrusions 201, 202, 203 may be arranged exclusively in the area of the knuckles, in the area of the backside of the hand 160 or in the area of the thumb 110, in particular in the area of the base joint of the thumb. Protrusions may also be arranged on the complete backside of a glove like glove 100. Protrusions may also be located on the frontside of a glove such as glove 100, in addition to or instead of gripping elements such as gripping elements 121, 123, 125 and/or strips such as strips 122, 124. Protrusions such as protrusions 201, 202, 203 may also protrude from an inner side of the glove, i.e., be located inside the glove and extend towards the surface of the wearer's hand.

The protrusions 201, 202, 203 are individually attached to the backside of the glove 100, so they do not protrude from a common base element. This generally allows an even more flexible configuration of a glove. In some embodiments, the bases of protrusions such as protrusions 201, 202, 203 do not touch, while in others they do. In other embodiments, at least two or more protrusions protrude from a common base element. In some embodiments, all protrusions protrude from a common base element. The protrusions may also be attached to an inner layer (not shown) of a backside of a glove such as the glove 100 and extend through the outermost layer of the backside of the glove.

In some embodiments, protrusions such as protrusions 201, 202, 203 are applied to the backside of a glove such as glove 100 using a mold, for example using a one-piece metal mold. For example, the one or more materials from which the protrusions are to be formed are first placed in the mold in a liquid state. The mold contains recesses that correspond to the desired protrusions—the recesses are, for example, negatives of the desired protrusions. In addition, air may be removed from the mold during and/or after this process. A press then presses the backside of the glove onto and/or into the metal mold with the liquid material inside. Due to the effect of heat and/or pressure, the liquid material diffuses at least into the surface of the backside of the glove. The protrusions are therefore applied to the backside of the glove by means of vulcanization, for example.

The protrusions 201, 202, 203 include silicone. Alternatively or additionally, protrusions such as protrusions 201, 202, 203 may also include (soft) polymeric materials such as polyurethane or rubber. In some embodiments, protrusions such as protrusions 201, 202, 203 may also include a layered structure. For example, layers located on the backside of the glove could include silicone, which is particularly easy to apply to the backside of the glove, for example by vulcanization as just described, while layers located in end portions of the protrusions could include rubber, so that abrasion from contact with a ball may be kept low.

In some embodiments, protrusions such as protrusions 201, 202, 203 include hardness values in the range of 10-50 Shore A, preferably in the range of 15-35 Shore A, particularly preferably in the range of 20-30 Shore A, and in particular a hardness of 26 Shore A.

The person skilled in the art understands that the material composition and hardness of protrusions such as protrusions 201, 202, 203 may generally be varied individually and independently of each other across the backside of the glove. Therein, among other things, the intended use and/or the environment in which the glove will be used may be taken into account, for example, whether the glove will be used for indoor soccer or on a grass pitch.

Figure 2:
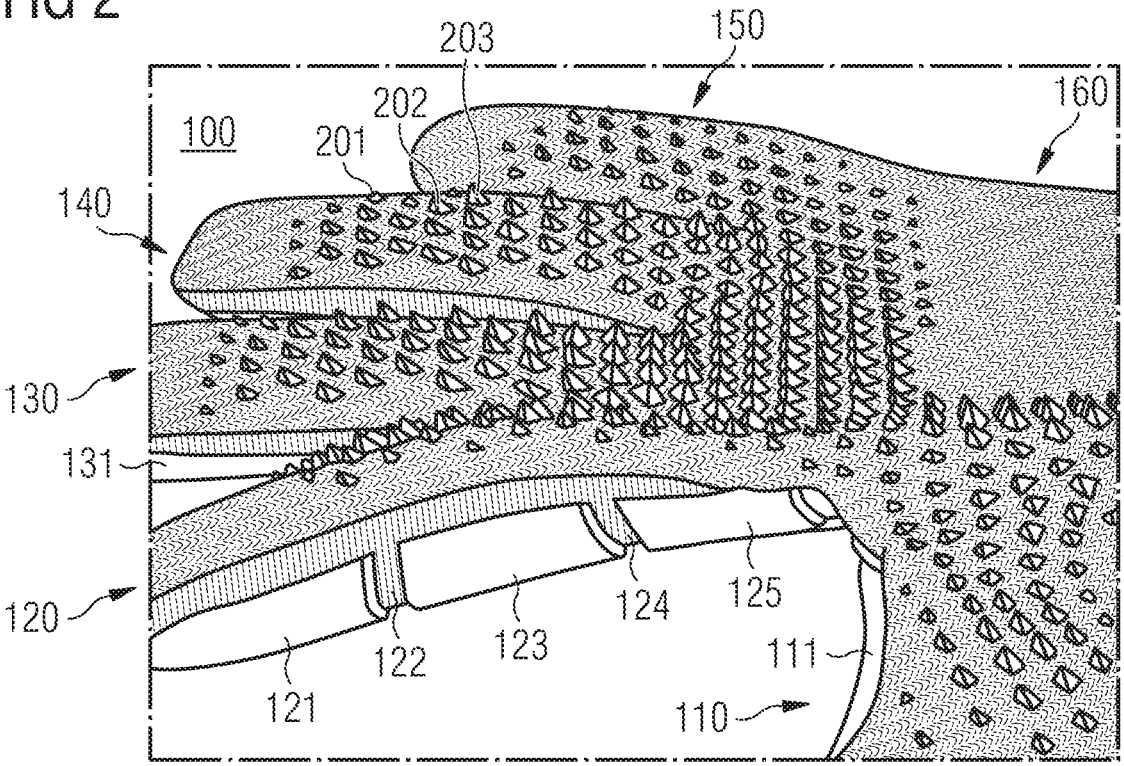
FIG. 2 shows a detailed view of the embodiment of FIG. 1.

FIG. 2 shows a detailed view of the glove 100 from FIG. 1, so the above explanations apply analogously. In particular, FIG. 2 shows the plurality of protrusions 201, 202, 203 (not all provided with reference signs) in more detail.

Figure 3:
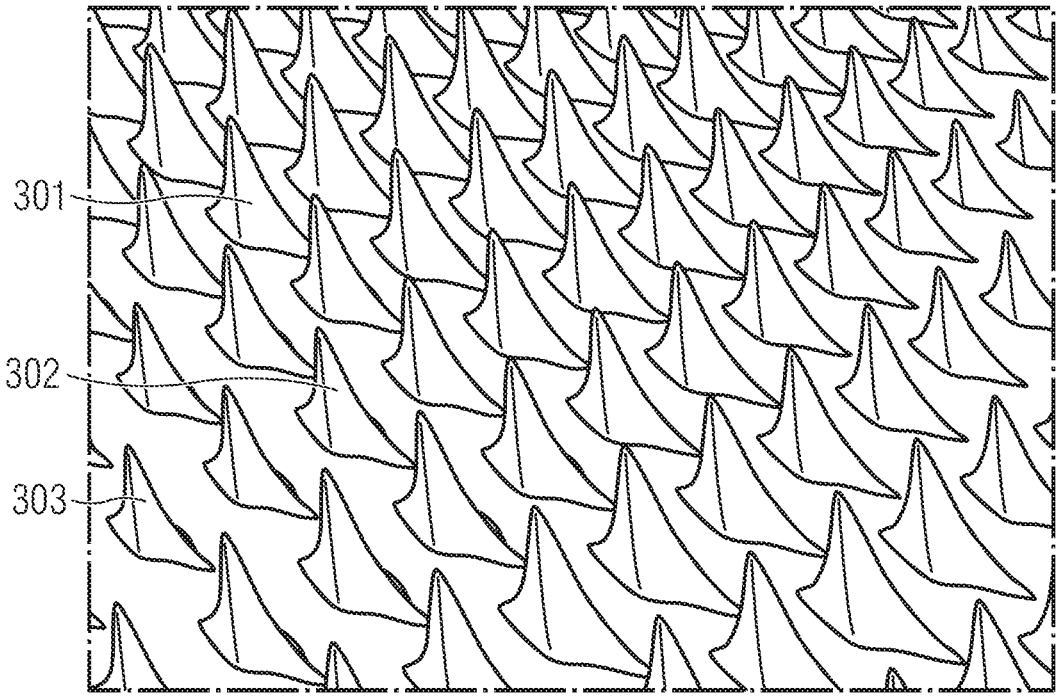
FIG. 3 shows a schematic representation of a plurality of protrusions.

At least in their shape, the protrusions 201, 202, 203 may correspond to the individual protrusions of the plurality of protrusions 301, 302, 303 (not all provided with reference signs), which is shown schematically in FIG. 3. The protrusions 301, 302, 303 include a substantially rhomb-shaped or kite-shaped base. The four corners of each base are rounded, but need not be so in other embodiments. In principle, protrusions such as protrusions 301, 302, 303 may include any base, including non-quadrilateral ones, such as triangular, square, parallelogram-shaped—or more generally polygonal. Linear or round bases are also possible, as they are provided in the embodiments of FIGS. 6A-8C (see below).

The protrusions 301, 302, 303 taper to a point, so their diameter varies along a first direction in which they extend. The resulting tip of the respective protrusions, which in this case forms a respective end portion of the protrusions 301, 302, 303, is not located centrally above the respective base, so that the protrusions 301, 302, 303 are arranged in a tilted orientation (or, in short, are tilted). In particular, the protrusions 301, 302, 303 are tilted towards one of the four corners of the respective base. More generally, protrusions such as protrusions 301, 302, 303 are arranged in a tilted orientation or are tilted if the center of volume of a protrusion does not lie with the center of area of the associated base on a straight line, which in turn is perpendicular to the base of the respective protrusion. Protrusions are asymmetrical (at least) in this sense.

The protrusions 301, 302, 303 each include four edges, which in turn each extend from a (rounded) corner of the rhomb-shaped or kite-shaped base of the corresponding protrusion 301, 302, 303 towards the end portion. These four edges are slightly concave in the embodiment of FIG. 3. In particular, those edges that protrude from the corner towards which the respective protrusion is tilted and those edges that start from the respective opposite corner are more concave than the other edges. Thus, the protrusions 301, 302, 303 are curved. All in all, the protrusions 301, 302, 303 thus resemble shark fins.

Figure 4:
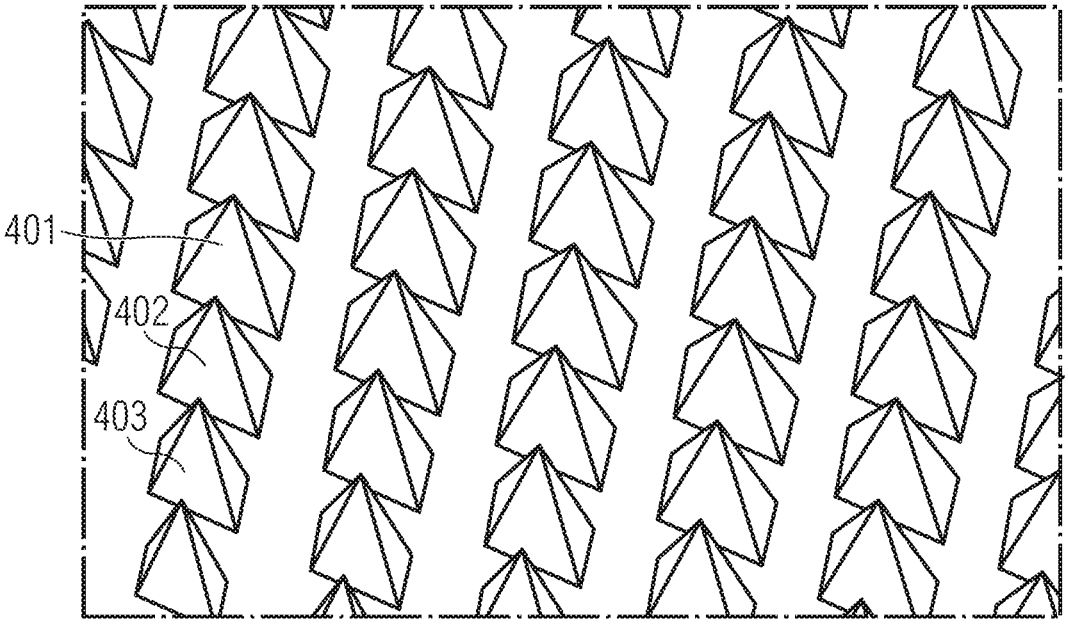
FIG. 4 shows a schematic representation of another plurality of protrusions.

In principle, however, any other shapes are also possible for protrusions. FIG. 4 shows a corresponding alternative embodiment of protrusions 401, 402, 403 (not all provided with reference signs). The protrusions 401, 402, 403 include a square base and taper to a point, so that they include a pyramid-like shape. However, protrusions 401, 402, 403 are tilted so that their end portions or tips are not located centrally above the square base. Furthermore, the protrusions 401, 402, 403 are not tilted towards a corner of the base as protrusions 301, 302, 303 of the embodiment of FIG. 3, but towards an edge of the square base.

Figure 5:
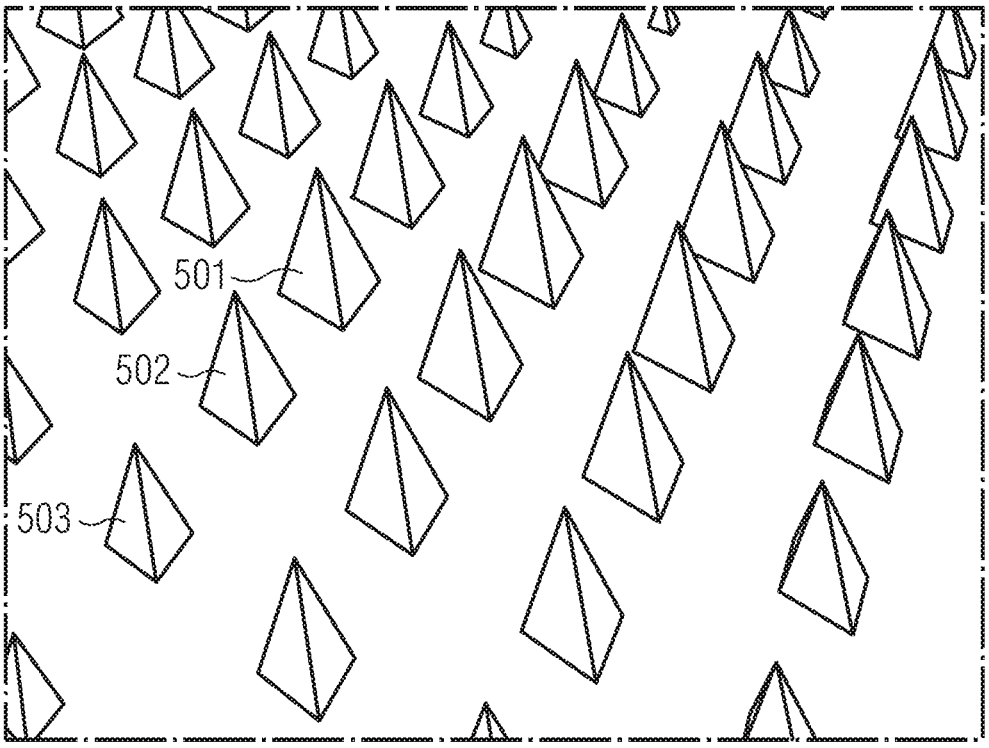
FIG. 5 shows a schematic representation of another plurality of protrusions.

On the other hand, FIG. 5 shows a plurality of protrusions 501, 502, 503 (not all provided with reference signs), each of which also has a square base and tapers to a point like a pyramid. But the protrusions 501, 502, 503 are tilted towards a corner of their respective square base. In addition, the protrusions 501, 502, 503 are further apart than the protrusions 401, 402, 403 of the embodiment of FIG. 4.

The protrusions 301, 302, 303 of the embodiment of FIG. 3, the protrusions 401, 402, 403 of the embodiment of FIG. 4 and the protrusions 501, 502, 503 vary in size but are all tilted in the same direction. In other embodiments, however, the orientation of the protrusions or their tilt may vary at least partially.

Figure 6A:
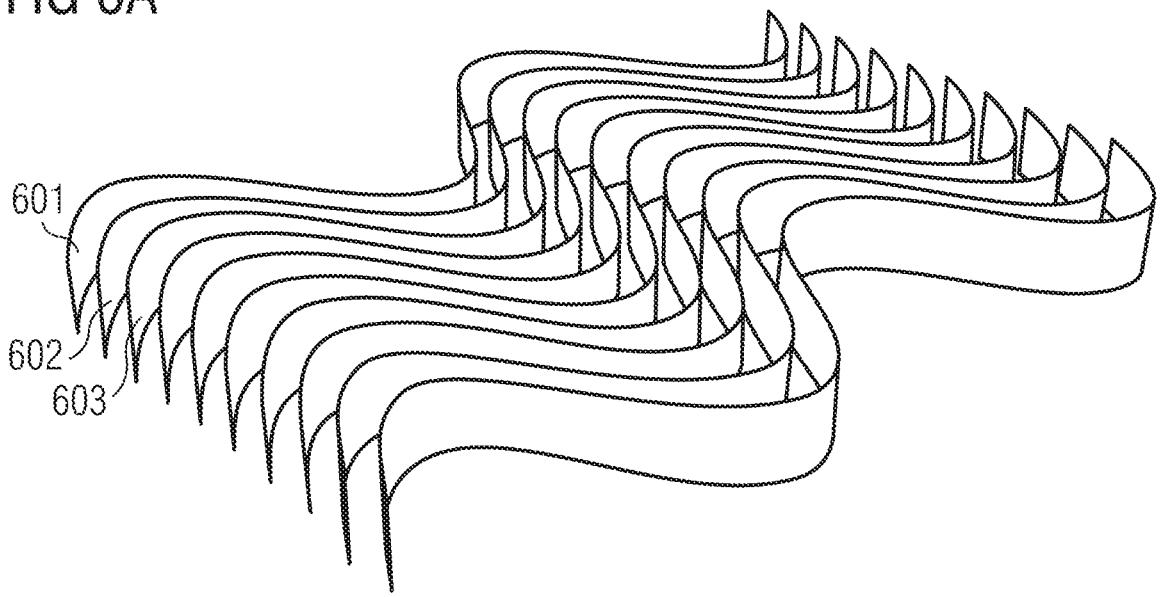
FIGS. 6A-B show schematic representations of another plurality of protrusions.
Figure 6B:
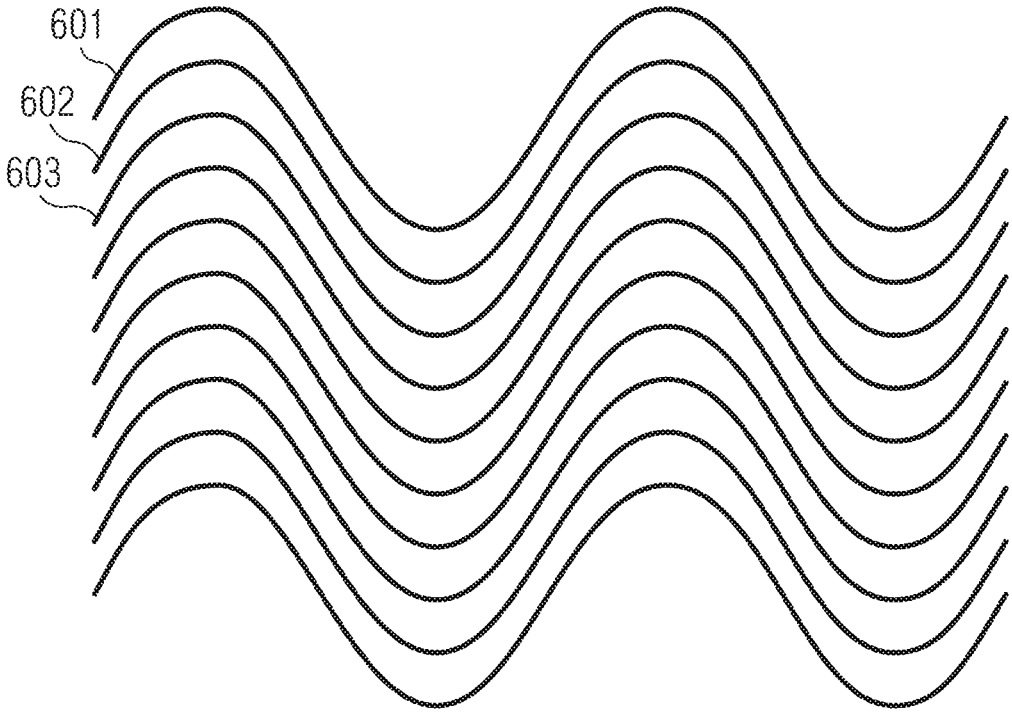

FIGS. 6A and 6B show another possible embodiment of protrusions 601, 602, 603 (not all provided with reference signs). As shown in particular in the top view of FIG. 6B, the protrusions 601, 602, 603 each include a linear base. The linear bases of protrusions 601, 602, 603 are parallel. Furthermore, the linear bases of protrusions 601, 602, 603 include a uniform waveform. In the embodiment of FIGS. 6A and 6B, the linear bases of protrusions 601, 602, 603 each describe two periods. In other embodiments, however, the linear bases of the protrusions 601, 602, 603 may also differ in length and shape.

From the linear bases the protrusions 601, 602, 603 extend in a first direction. The protrusions 601, 602, 603 include an essentially wall-like or lamella-like shape. They do not taper to a point; their diameter precisely does not vary along the first direction. However, this may be the case in other embodiments.

Figure 7A:
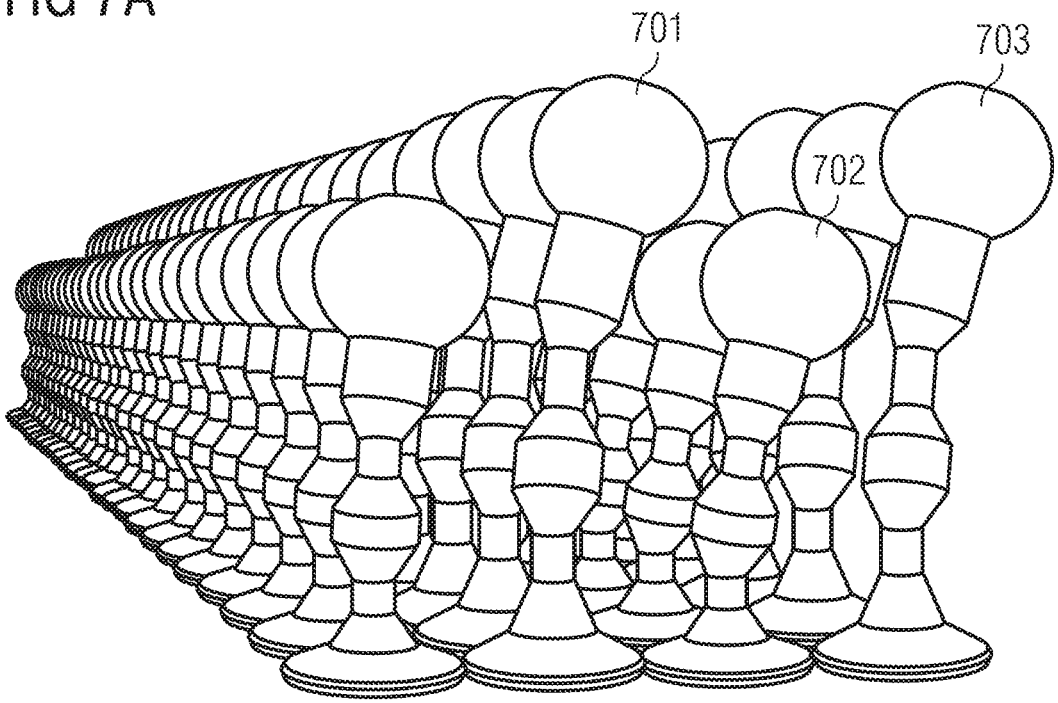
FIGS. 7A-B show schematic representations of another plurality of protrusions.
Figure 7B:
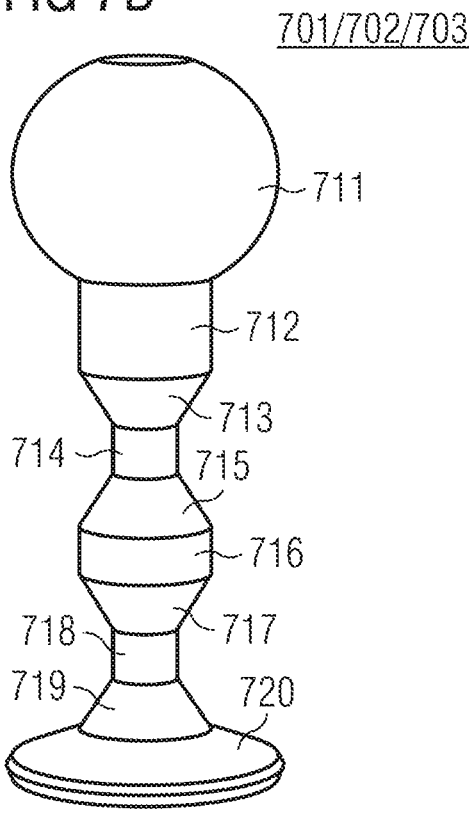

FIGS. 7A and 7B show another possible embodiment of protrusions 701, 702, 703 (not all provided with reference signs) that extend in a first direction. As shown in particular in FIG. 7B, protrusions 701, 702, 703 include a round base corresponding to an underside of a foot 720 of a protrusion 701, 702, 703. The foot 720 is followed in the first direction by a frustoconical element 719, which also includes a smaller diameter than the foot 720. Protrusion 701, 702, 703 thus tapers in this area. A cylindrical element 718 is flush with the frustoconical element 719 in the first direction. The cylindrical element 718 is in turn flush with another frustoconical element 717, the diameter of which increases evenly along the first direction from the cylindrical element 718. Another cylindrical element 716 is flush with the other side of the frustoconical element 717. The cylindrical element 716 is accordingly larger in diameter than the cylindrical element 718. The cylindrical element 716 is followed by a sequence of elements 715, 714, 713, which substantially correspond to the elements 719, 718, 717. The element 713, which is thus frustoconical, is then followed, flush in the first direction, by another cylindrical element 712 whose diameter corresponds to that of the cylindrical element 716. However, the cylindrical element 712 is approximately twice as high as the cylindrical element 716. The cylindrical element 712 is followed in the first direction by an end portion of the protrusion 701, 702, 703, which has a spherical or ellipsoidal shape.

In total, the diameter of the protrusion 701, 702, 703 thus varies along the first direction. The partial taper of the protrusion 701, 702, 703 may act like a notch, i.e., facilitate a deformation of the protrusion 701, 702, 703. In other embodiments, at least one protrusion includes another type of notch that facilitates deformation. More generally, there could be a notch in a side of a protrusion from which the protrusion is tilted away. Notches may include any shape and depth. In some embodiments, also a perforation may extend through a protrusion to facilitate its deformation. Such a perforation is also to be understood as a notch.

The protrusions 701, 702, 703 are preferably elastically or reversibly deformable, i.e., they resume their original shape as soon as no more force is applied to them.

The plurality of protrusions 701, 702, 703 is arranged in such a way that the feet 720 of the protrusions 701, 702, 703 touch each other. In addition, the protrusions 701, 702, 703 are arranged uniformly and their feet 720 are arranged in a kind of checkerboard pattern. The plurality of protrusions 701, 702, 703 includes protrusions 701, 702, 703 of at least two different heights. A difference in height may be due to the fact that some of the protrusions 701, 702, 703 are stretched or compressed in the first direction compared to others of the protrusions 701, 702, 703. However, a difference in height may also be caused by the fact that individual elements such as elements 712-719, in particular the cylindrical elements 718, 716, 714 and/or 712, of individual protrusions 701, 702, 703 are designed to be higher. The plurality of protrusions 701, 702, 703 is arranged in such a way that only protrusions 701, 702, 703 of the same height are in a row. The adjacent row, however, only includes protrusions 701, 702, 703 of the other of the two heights.

In combination with the spherical or ellipsoidal end portions 711 of the protrusions 701, 702, 703, this arrangement may allow the higher protrusions 701, 702, 703 to abut against the smaller protrusions 701, 702, 703 when deformed in a second direction. Alternatively or additionally, the smaller protrusions 701, 702, 703 may also abut against the higher protrusions 701, 702, 703 when deformed in a second direction. In general, protrusions such as the protrusions 701, 702, 703 may be adapted to abut against each other, e.g., against adjacent protrusions 701, 702, 703 when deformed in the second direction.

Figure 8A:
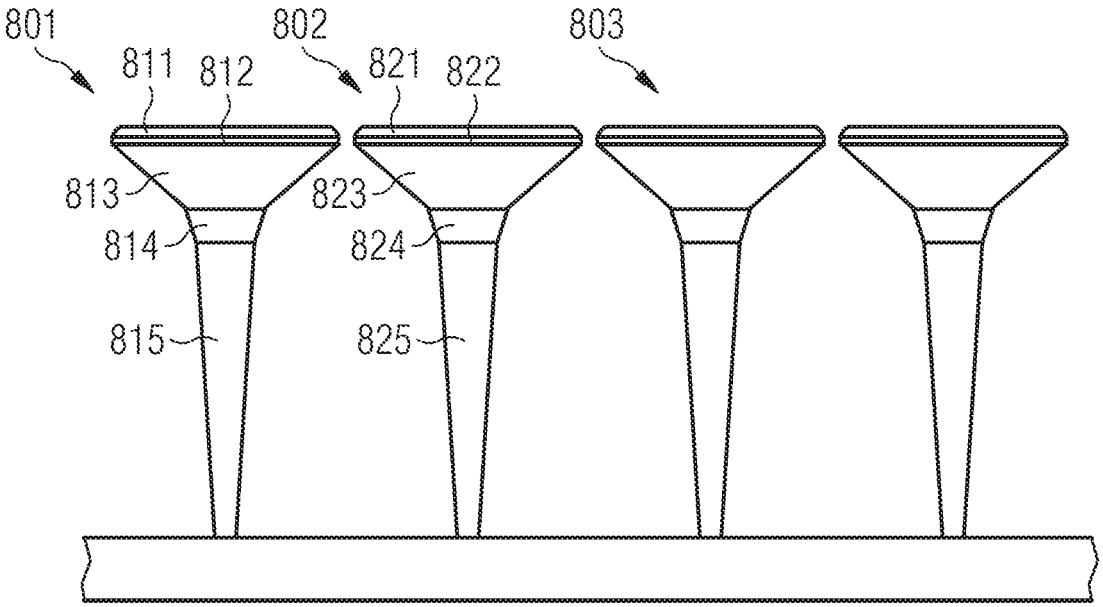
FIGS. 8A-C show schematic representations of another plurality of protrusions.
Figure 8B:
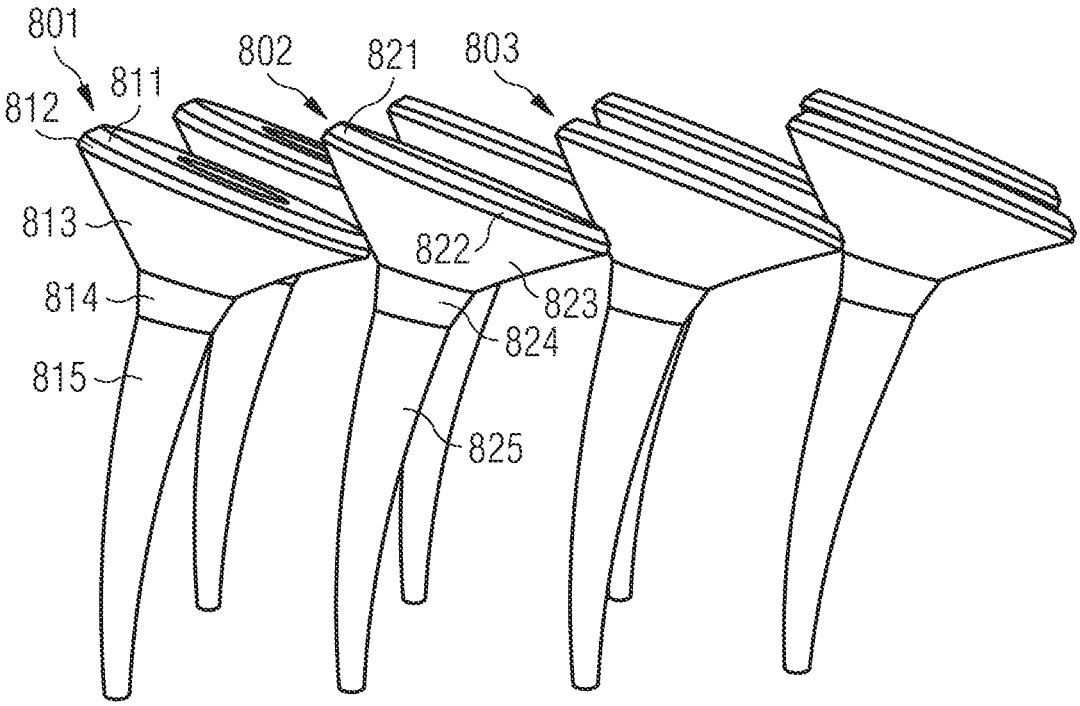
Figure 8C:
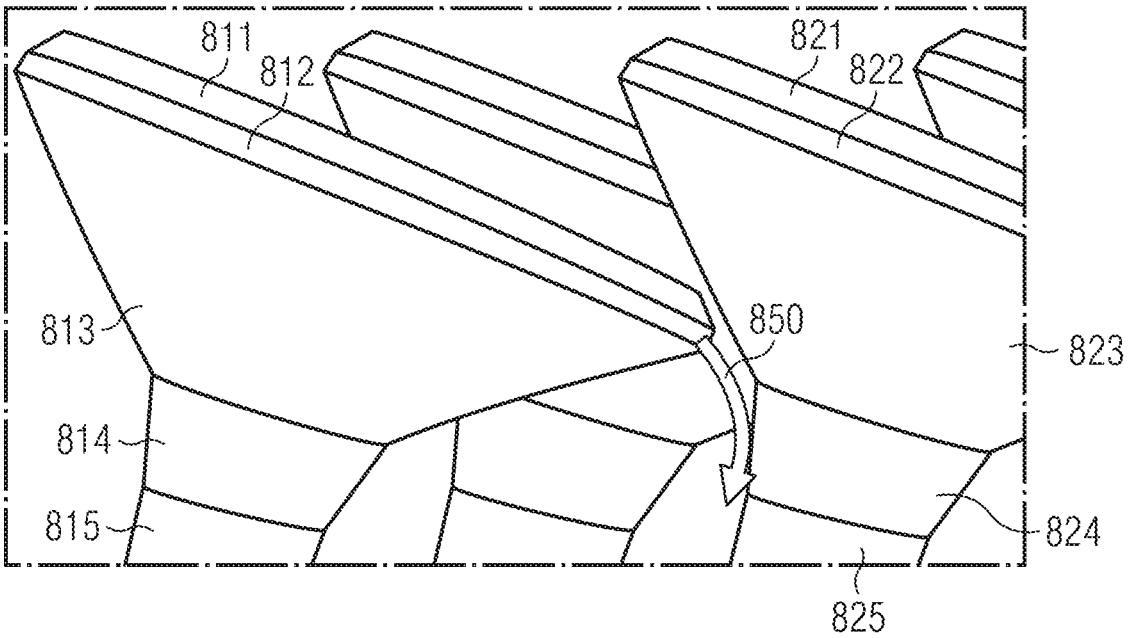

FIGS. 8A-8C show another possible embodiment of protrusions 801, 802, 803 (not all provided with reference signs) that extend in a first direction. In particular, FIG. 8A shows the protrusions 801, 802, 803 before any deformation. FIGS. 8B and 8C, on the other hand, show the protrusions 801, 802, 803 during a deformation, for example by contact with a ball moving in a direction comprising a component perpendicular to the first direction (in the plane of the image, for example, to the right). The protrusions 801, 802, 803 each include a round base corresponding to a lower end of a lowermost frustoconical element 815 or 825. The frustoconical elements 815, 825 grow wider along the first direction, thus their diameter increases. The lowermost frustoconical elements 815, 825 are flush with other frustoconical elements 814, 824, which also grow wider along the first direction. The frustoconical elements 814, 824 thereby widen more strongly than the frustoconical elements 815, 825; a slope in the first direction of a lateral surface of the frustoconical elements 814, 824 is thus smaller in amount than a slope in the first direction of a lateral surface of the frustoconical elements 815, 825. Further frustoconical elements 813, 823 are flush with the frustoconical elements 814, 824 in the first direction, which in turn widen even more strongly along the first direction than the frustoconical elements 814, 824. Cylindrical elements 812, 822 of low height are flush with the frustoconical elements 813, 823 in the first direction. These cylindrical elements 812, 822 are followed in the first direction by other frustoconical elements 811, 821 of low height. The frustoconical elements 811, 821 taper along the first direction, so relative to the cylindrical elements 812, 822 the diameter of the protrusions 801, 802, 803 decreases again, whereas it previously increased at the level of the elements 813-815, 823-825 along the first direction.

The elements 811, 812, 813 and 821, 822, 823 form an end portion of the protrusions 801 and 802 respectively. Hence, the end portions of the protrusions 801, 802 and 803 include a funnel shape; if necessary, the funnel-shaped end portions may also include recesses on the top. This, in combination with a symmetrical, checkerboard-like arrangement of the protrusions 801, 802, 803—similar to the protrusions 701, 702, 703 of the embodiments of FIGS. 7A and 7B—results in the protrusions 801, 802, 803 abutting against each other when deformed in a second direction that includes a component perpendicular to the first direction. In particular, a deformation in the second direction may cause a frustoconical element 811, 821 of a protrusion 801, 802, 803 to come into contact with a frustoconical element 813, 823 of an adjacent protrusion 801, 802, 803. This is shown in particular detail in FIG. 8C. Deformation in the second direction causes an end portion of a protrusion 801, 802, 803 to move in a direction illustrated by an arrow 850. In particular, the end portion thus moves under an end portion of an adjacent protrusion 801, 802, 803. Adjacent protrusions 801, 802, 803 may thus support each other. This may even lead to a kind of chain reaction, as shown in FIG. 8B: each protrusion 801, 802, 803 abuts against an adjacent protrusion 801, 802, 803 in the second direction. In some embodiments, the lateral surfaces of the protrusions or of individual elements such as elements 811-815, 821-825 may also be specially adapted with this effect in mind. For example, they may include a rough surface.

In general, the skilled person understands from the foregoing that each individual protrusion may be provided in any shape, in any size, in particular in any height, and/or in any orientation independently of the others of the plurality of protrusions. Each protrusion may also extend in any first direction. Likewise, protrusions may be arranged in any number, at any distance, in any (distribution-)density and in any area. Therefore, the embodiment of FIGS. 1 and 2, in which the protrusions 201, 202, 203 include the same shape and orientation—namely towards the tips of the fingers 120, 130, 140, 150—but different sizes, is to be understood purely as an example. The embodiments of FIGS. 3-8C are also not to be understood in a limiting way; many other forms for protrusions are conceivable, such as a bristle form, for example, as is known from toothbrushes or brooms and is shown schematically for protrusion 1401 of FIG. 12. Rather, all the mentioned parameters may be freely selected and varied, depending on the intended use of the glove and, if necessary, also on the needs of the wearer.

Figure 9A:
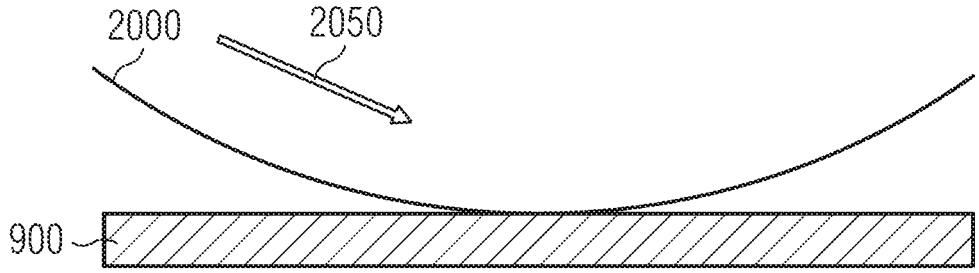
FIGS. 9A-C show a schematic diagram of a possible mode of operation of a plurality of protrusions.
Figure 9B:
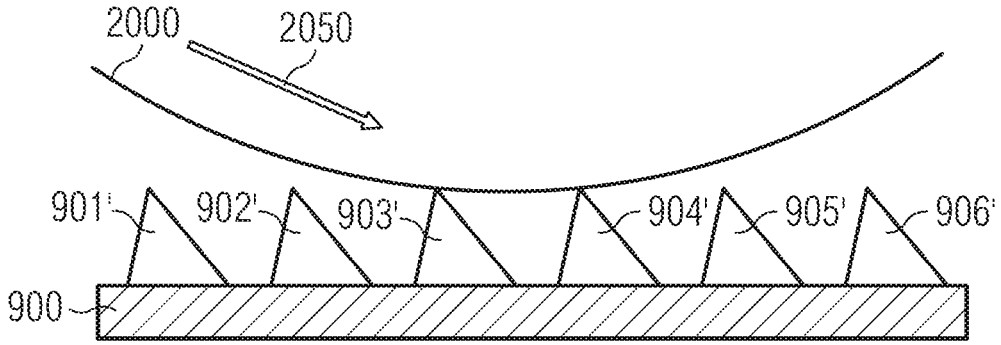
Figure 9C:
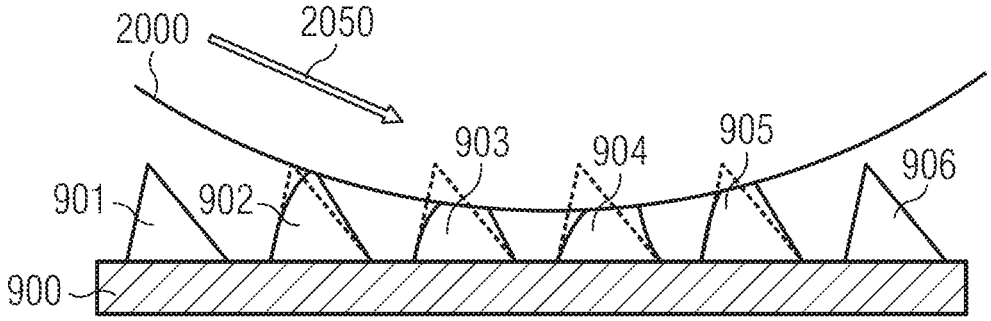

FIGS. 9A-9C, in particular FIG. 9C, illustrates the advantages a glove with deformable protrusions provides as compared to a glove entirely without protrusions (FIG. 9A) as well as compared to a glove with non-deformable protrusions (FIG. 9B).

For example, if a ball 2000 hits a smooth backside 900 of a glove, i.e., one that is not provided with protrusions, at least partially parallel, as indicated by arrow 2050, the backside 900 of the glove and the ball 2000 touch in only one point, as shown in FIG. 9A. The contact area is therefore very small.

If the backside 900 of the glove includes a plurality of non-deformable protrusions 901', 902', 903'. 904', 905', 906', as shown in FIG. 9B, the backside 900 of the glove and the ball 2000 touch each other in three dimensions in a maximum of three points. In the two-dimensional diagram in FIG. 9B, this is illustrated as a contact of the ball 2000 with the protrusions 903' and 904'. The contact area between the backside 900 of the glove and the ball 2000 is therefore larger than in the case shown in FIG. 9A, but still comparatively small.

However, if the backside 900 of the glove includes a plurality of protrusions 901, 902, 903, 904, 905, 906 which protrude from a backside 900 of the glove, extend in a first direction away from the backside 900 of the glove and are adapted to deform in a second direction that includes a component perpendicular to the first direction (see also the detailed description of FIG. 12 below), these are deformed by contact with the ball 2000. In particular, as shown in FIG. 9C, they may be deformed in the second direction, in particular tilted, sheared or bent; the ball 2000 may thus "pull" the protrusions 901, 902, 903, 904, 905, 906 along to a certain extent so that the protrusions 901, 902, 903, 904, 905, 906 may virtually "hook" into the ball. In particular, the contact area between the backside 900 of the glove and the ball 2000 may thus be increased: Instead of only the end portions or tips of individual protrusions, as illustrated in FIG. 9B, the ball also comes into contact, as illustrated in FIG. 9C, with the lateral surfaces of multiple of the protrusions 901, 902, 903, 904, 905, 906 when they are deformed, especially when they are tilted and/or sheared in the second direction and/or bent towards the backside 900 of the glove. In some embodiments, the lateral surfaces of the protrusions may also be specially adapted with this effect in mind. For example, they may include a rough surface to further increase the friction between the protrusions and the ball.

In the embodiment of FIG. 9C, the protrusions 901, 902, 903, 904, 905, 906 are deformed, for example tilted, sheared or bent, against a tilt they include. This may cause the protrusions 901, 902, 903, 904, 905, 906 to build up a greater restoring force, which in turn may increase the friction between the protrusions 901, 902, 903, 904, 905, 906 or the backside 900 of the glove in total, respectively, and the ball 2000. However, the contact area between the backside 900 of the glove and the ball 2000 may also be increased by deformation in any other direction that includes a component perpendicular to the first direction.

Figure 10A:
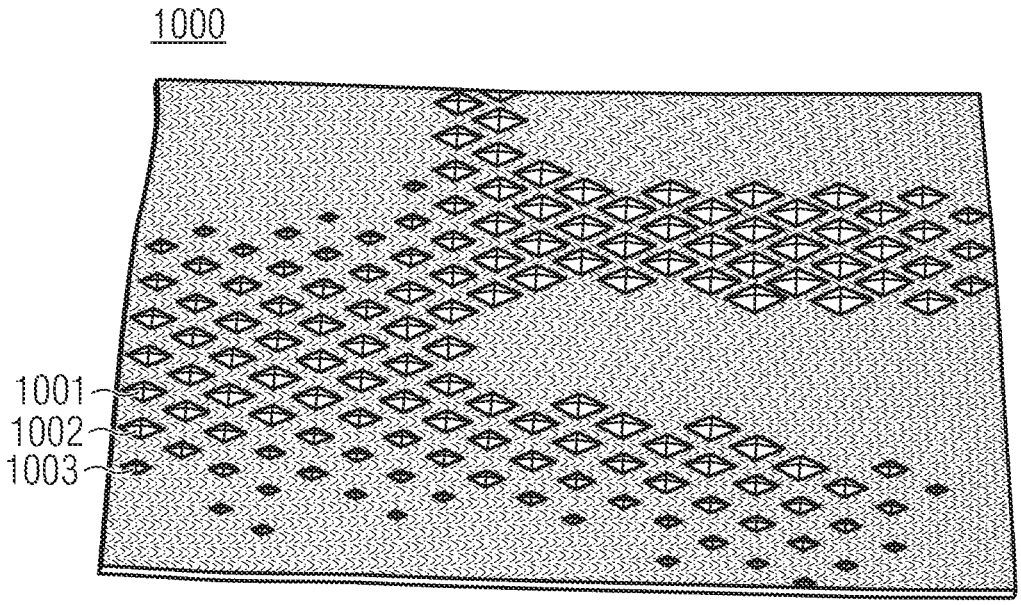
FIGS. 10A-B show test specimens with various pluralities of protrusions.
Figure 10B:
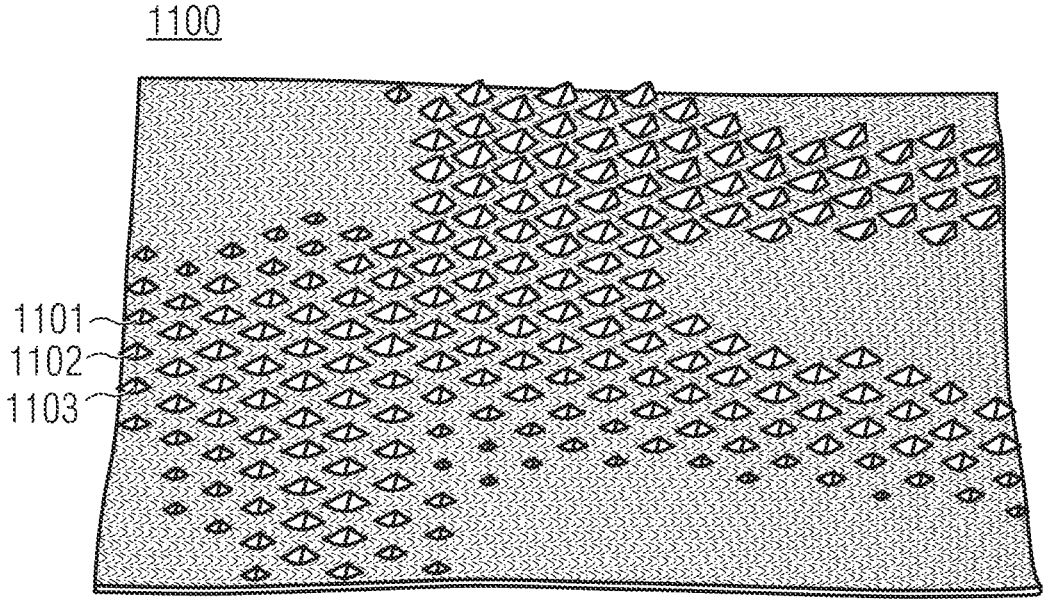

Protrusions thus enable an increased stiction between the glove and the ball and may therefore improve ball control. This may also be demonstrated by means of a test procedure, which is explained below with reference to FIGS. 10A-10D. Test specimens such as test specimens 1000, 1100, 1200 of FIGS. 10A-10C, are first pressed vertically onto a friction surface (or vice versa), for example onto friction surface 3000, which is shown in FIG. 10D. The friction surface 3000 includes a plurality of symmetrically arranged, rhomb-shaped protrusions 3010 (not all provided with reference signs). For example, while the test specimens 1000, 1100, 1200 are pressed onto friction surface 3000 with a force of 100 N (or vice versa), test specimens 1000, 1100, 1200 and friction surface 3000 are moved relative to each other in a direction perpendicular to this force. This movement may occur at a speed of 100 mm/min, for example. Furthermore, the movement may be stopped, for example, after the test specimens 1000, 1100, 1200 and the friction surface 3000 have moved 50 mm relative to each other.

Test specimen 1000 of FIG. 10A includes a plurality of protrusions 1001, 1002, 1003 (not all provided with reference signs), each of which includes a rhomb-shaped base and tapers to a point. The protrusions 1001, 1002, 1003 vary in size but not in orientation. The protrusions 1001, 1002, 1003 are also not arranged in a tilted orientation.

Test specimen 1100 of FIG. 10B also includes a plurality of protrusions 1101, 1102, 1103 (not all provided with reference signs). The protrusions 1101, 1102, 1103 essentially correspond to the protrusions 201, 202, 203 and 301, 302, 303 of the embodiments of FIGS. 1, 2 and 3, respectively. In particular, the protrusions 1101, 1102, 1103 are thus arranged in a tilted orientation, unlike the protrusions 1001, 1002, 1003 of the embodiment of FIG. 10A.

Test specimen 1200 of FIG. 10C, or its protrusions 1201, 1202, 1203, 1204 (not all provided with reference signs) is or are again known from the state of the art.

When the coefficient of static friction of the three test specimens 1000, 1100, 1200 is determined in four passes as described above, the results shown in Table 1 are obtained:

TABLE 1

| test | coefficient of static friction | | | | |
|---|---|---|---|---|---|
| specimen | 1st pass | 2nd pass | 3rd pass | 4th pass | Average |
| 1000 | 0.71 | 0.72 | 0.62 | 0.68 | 0.67 |
| 1100 | 0.85 | 0.86 | 0.85 | 0.87 | 0.86 |
| 1200 | 0.52 | 0.54 | 0.50 | 0.53 | 0.52 |

The stiction of a backside of a glove with a ball may therefore be increased more strongly by protrusions such as protrusions 1001, 1002, 1003, 1101, 1102, 1103 than by protrusions known from the state of the art such as protrusions 1201, 1202, 1203. The stiction may be increased to a particular high degree using tilted protrusions such as protrusions 1101, 1102, 1103.

Figure 11:
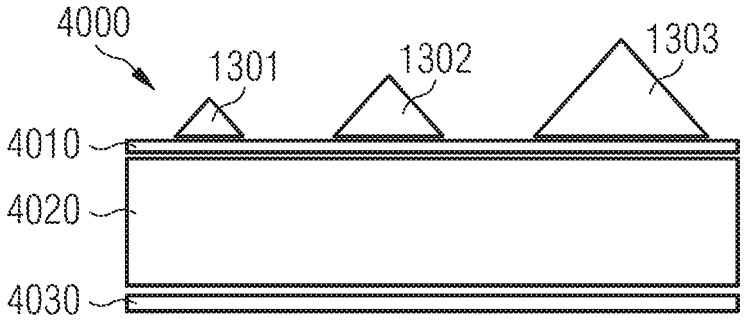
FIG. 11 shows a schematic representation of a layered structure of a backside of a glove.

FIG. 11 shows a possible layer structure of a backside 4000 of a glove. The backside 4000 of the glove includes a top layer 4010, a middle layer 4020 and a bottom layer 4030. On the top layer 4010, there are arranged protrusions 1301, 1302, 1303. Layer 4010 may include polyester, layer 4020 may include polyurethane, in particular polyurethane foam, and layer 4030 may include cotton. The layers 4010, 4020, 4030 may be designed in such a way that the backside 4000 of the glove consists of 48% polyester, 22% polyurethane foam and 30% cotton.

Figure 12:
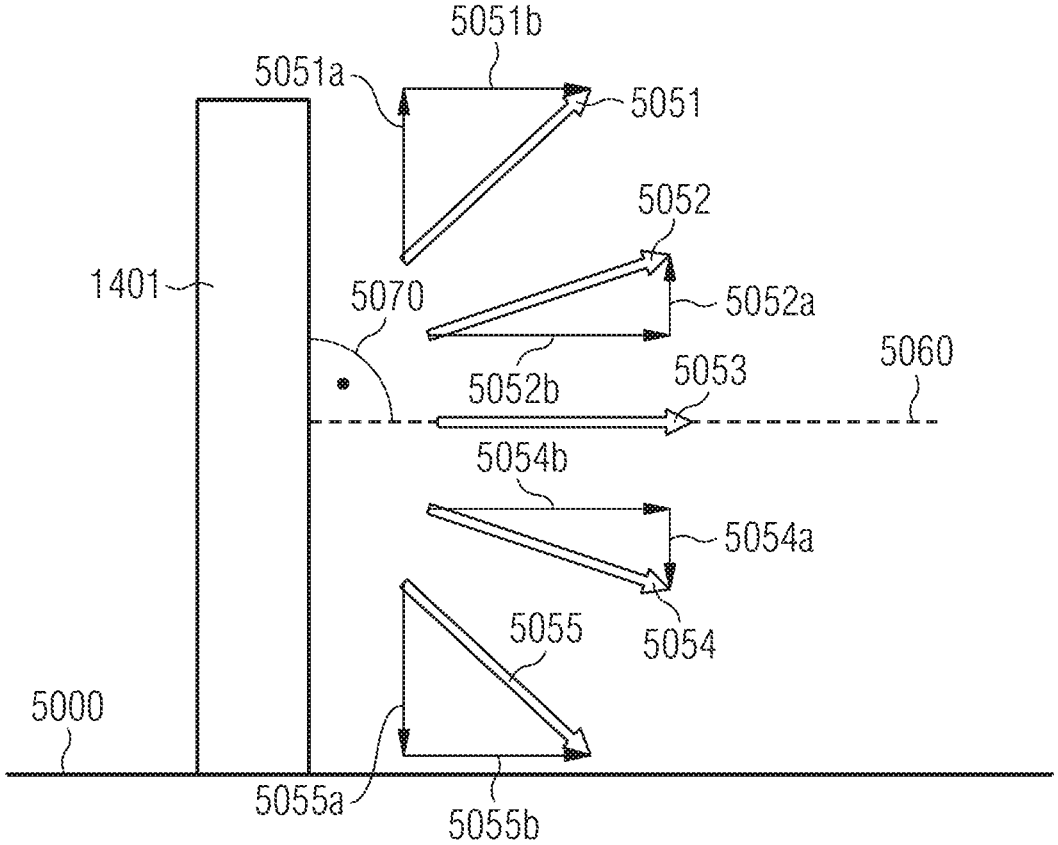
FIG. 12 shows a schematic representation of possible deformation directions.

FIG. 12 shows possible second directions 5051, 5052, 5053, 5054, 5055 of a deformation of a protrusion 1401, each comprising a component 5051*b*, 5052*b*, 5053*b* (not shown because identical to direction 5053), 5054*b*, 5055*b* perpendicular to a first direction in which the protrusion 1401 extends away from a backside 5000 of a glove. In addition, directions 5051, 5052, 5054, 5055 each also include a component 5051*a*, 5052*a*, 5054*a*, 5055*a* that is parallel or antiparallel to the first direction. Direction 5053, on the other hand, does not include such a component that is oriented parallel or antiparallel to the first direction. Line 5060 illustrates the direction that is exactly at a right angle 5070 to the first direction, i.e., the direction in which protrusion 1401 extends. Of the shown second directions 5051, 5052, 5053, 5054, 5055, only the second direction 5053 is exclusively parallel to line 5060 and thus perpendicular to the first direction. The other shown directions 5051, 5052, 5054, 5055 are not exclusively parallel to line 5060 and therefore not perpendicular to the first direction. But they include the components 5051*b*, 5052*b*, 5054*b*, 5055*b* which are perpendicular to the first direction, i.e., to the direction in which protrusion 1401 extends. In other words, a second direction includes a component perpendicular to the first direction if it is not completely parallel or antiparallel to the first direction. The illustration of possible second directions in FIG. 12 is not exhaustive, but merely serves to provide a better understanding.

What is claimed is:

1. A glove comprising:

a fingertip portion;

a backside comprising a first material; and a plurality of protrusions, wherein the protrusions protrude from the backside of the glove and extend in a first direction away from the backside, wherein the protrusions each comprise a second material that differs from the first material and have a base located on the backside of the glove, wherein the bases are unconnected to one another by any portion of the second material, and wherein the protrusions are configured to return to an undeformed resting shape when unloaded, and the undeformed resting shape extends from the base at an angle inclined toward the fingertip portion;

wherein the base of at least one protrusion among the plurality of protrusions is kite-shaped.

2. The glove according to claim 1, wherein the contact area is increased by multiple of the plurality of protrusions being tilted or sheared in the second direction.

3. The glove according to claim 1, wherein at least one protrusion comprises a notch facilitating deformation.

4. The glove according to claim 1, wherein an end portion of at least one protrusion comprises a spherical shape, an ellipsoidal shape or a funnel shape.

5. The glove according to claim 1, wherein at least one protrusion is curved.

6. The glove according to claim 1, wherein at least two protrusions differ in size, in particular height, shape or orientation.

7. The glove according to claim 1, wherein each protrusion is individually attached to the backside of the glove.

8. The glove according to claim 1, wherein the protrusions are arranged in an area of knuckle portions of finger portions of the glove, in an area of the backside of the glove or in an area of a thumb portion of the glove.

9. The glove according to claim 1, wherein the number of protrusions per unit area varies across the backside of the glove.

10. The glove according to claim 1, wherein at least one protrusion comprises silicone.

11. The glove according to claim 1, wherein at least one protrusion comprises a hardness in the range of 10-50 Shore A, preferably in the range of 15-35 Shore A, particularly preferably in the range of 20-30 Shore A, in particular a hardness of 26 Shore A.

12. The glove of claim 1, comprising a frontside and gripping elements, wherein the gripping elements are arranged on the frontside in a formation that differs from the plurality of protrusions on the backside.

13. The glove of claim 1, wherein a kite shape of the kite-shaped base comprises a triangle pointed toward the fingertip portion and an elongated tail extending from the triangle in a direction away from the fingertip portion, and wherein the elongated tail is longer than the triangle.

14. A glove comprising: a fingertip portion; a plurality of flat gripping elements arranged on a front side of the glove; a plurality of protrusions comprising a first material, wherein the protrusions protrude from a backside of the glove, the backside of the glove comprising a second material that differs from the first material, and extend in a first direction away from the backside, wherein: the protrusions are configured to deform in a second direction that comprises a component perpendicular to the first direction; the protrusions each include a respective protrusion base located directly on the backside of the glove and on the fingertip portion; wherein the protrusion base of at least one protrusion among the plurality of protrusions is kite-shaped; the protrusions are unconnected to one another by any portion of the first material; and each protrusion among the plurality of protrusions has an undeformed resting shape that tapers from the protrusion base to a tip that is offset toward the fingertip portion of the glove from an axis extending perpendicularly from the protrusion base and through a center of the protrusion base.

15. The glove according to claim 14, wherein the plurality of protrusions is configured to deform in the second direction upon contact of the backside of the glove with a ball such that a contact area of the glove with the ball is larger than without a deformation of the plurality of protrusions.

16. The glove according to claim 14, wherein at least one protrusion is arranged in an orientation tilted towards the backside of the glove before deformation.

17. The glove according to claim 16, wherein the at least one protrusion is configured to become deformed against its tilted orientation upon contact of the backside of the glove with a ball.

18. The glove according to claim 14, wherein at least one protrusion is configured to abut against an adjacent protrusion when the at least one protrusion is deformed in the second direction.

19. The glove according to claim 14, wherein the undeformed resting shape has a center of volume that is offset toward the fingertip portion from the axis.

20. A glove comprising: a finger portion terminating at a fingertip portion; a plurality of flat gripping elements arranged on a front side of the finger portion; and a plurality of protrusions, wherein: the protrusions protrude from a backside of the glove and extend in a first direction away from the backside, the protrusions are configured to deform in a second direction that comprises a component perpendicular to the first direction, the protrusions each have a base located on the backside of the glove at a portion of the finger portion configured to be arranged at a joint of a wearer's finger when the glove is worn, wherein the base of at least one protrusion among the plurality of protrusions is kite-shaped; and the protrusions are each configured to return to an undeformed resting shape when unloaded, and the undeformed resting shape extends from the base at an angle inclined toward the fingertip portion.

* * * * *